US006606767B2

(12) United States Patent
Wong

(10) Patent No.: US 6,606,767 B2
(45) Date of Patent: Aug. 19, 2003

(54) MAGNETIC STRAP FASTENER

(76) Inventor: Sheung Chung Wong, 1011-1016, A, B, C, 10/F, Block 1, Wang Cheong Factory Estate, 781 Lai Chi Kok Road, Kowloon (HK)

( * ) Notice: Subject to any disclaimer, the term of this patent is extended or adjusted under 35 U.S.C. 154(b) by 0 days.

(21) Appl. No.: 09/964,531

(22) Filed: Sep. 28, 2001

(65) Prior Publication Data

US 2003/0005558 A1 Jan. 9, 2003

Related U.S. Application Data

(63) Continuation-in-part of application No. 09/920,015, filed on Aug. 2, 2001.

(30) Foreign Application Priority Data

Jul. 9, 2001 (HK) ..... 01104728

(51) Int. Cl.[7] ..... A44B 21/00
(52) U.S. Cl. ..... 24/303
(58) Field of Search ..... 24/303, 66.1; 292/251.2; 248/206.5; 335/285

(56) References Cited

U.S. PATENT DOCUMENTS

| | | | | |
|---|---|---|---|---|
| 3,063,118 A | | 11/1962 | Brown et al. | |
| 3,192,747 A | * | 7/1965 | Stupell et al. | |
| 3,293,714 A | * | 12/1966 | Shafer | 24/303 |
| 3,372,443 A | * | 3/1968 | Daddonna, Jr. | 24/303 |
| 4,231,137 A | * | 11/1980 | Fujimoto | 24/303 |
| 5,050,276 A | * | 9/1991 | Pemberton | 24/303 |
| 5,432,986 A | * | 7/1995 | Sexton | 24/303 |
| 5,664,298 A | * | 9/1997 | Nessar-Ivanovic | 24/303 |
| 6,282,760 B1 | * | 9/2001 | Mars | 24/303 |
| 6,292,985 B1 | * | 9/2001 | Grunberger | 24/303 |

FOREIGN PATENT DOCUMENTS

| | | | |
|---|---|---|---|
| CN | 8520 2635 U | | 12/1987 |
| DE | 23 23 058 | | 11/1974 |
| EP | 0 490 663 | | 6/1992 |
| EP | 0 923 887 | | 6/1999 |
| EP | 0923887 A2 | | 6/1999 |
| JP | 58-108716 | * | 6/1983 |

* cited by examiner

*Primary Examiner*—James R. Brittain
(74) *Attorney, Agent, or Firm*—Burns, Doane, Swecker & Mathis, L.L.P.

(57) ABSTRACT

A strap fastener comprising a pair of engageable magnetic fasteners of opposite polarity to each other engageable or a common axis, a strap engagement portion connected to each magnetic fastener and extending transverse to said common axis of engagement of said magnetic fasteners; and at least one protrusion to reside against a perimeter of an opposed magnetic fastener to resist movement of one magnetic fastener with respect to the other transverse to said common axis on which they engage.

24 Claims, 5 Drawing Sheets

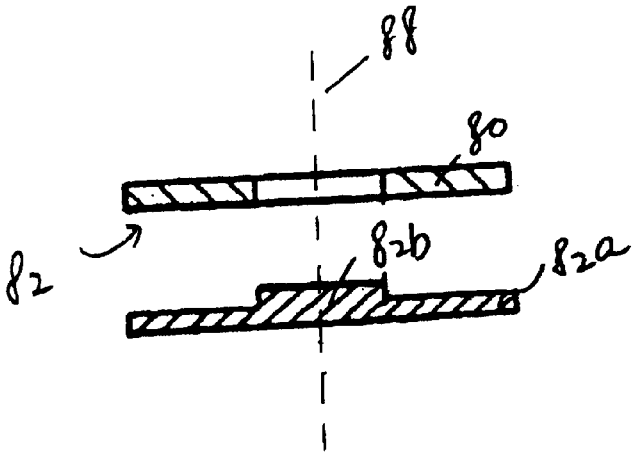
Fig. 7A
Fig. 7B
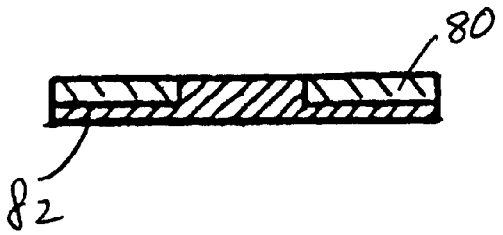
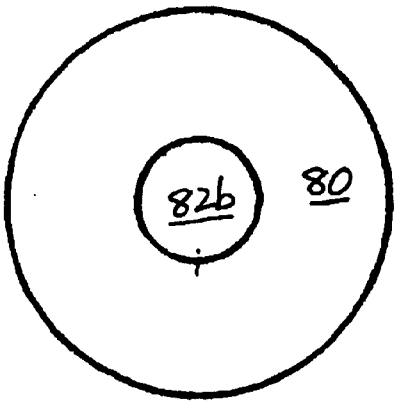
Fig. 7C

MAGNETIC STRAP FASTENER

FIELD OF THE INVENTION

The present invention relates generally to buckles and belt or strap fasteners and, more particularly, to magnetic fasteners such as magnetic buckles and magnetic strap fasteners. More specifically, although not solely limiting thereto, the present invention also relates to fasteners or buckles for use in or with a brassiere or the like.

BACKGROUND OF THE INVENTION

Unlike conventional fastener assemblies such as an array of buttons in which a button is fastened and released by inserting it into or removing it from a button hole, magnetic buttons and fasteners are fastened or secured by mutual magnetic attraction between a complementary pair of magnetic fasteners or buttons having complementary or opposite magnetic properties. This unique property of magnetic fasteners means that they can be automatically fastened when a detachable pair is in the proximity of each other. At the same time, coupled magnetic buttons can be separated simply by pulling the fasteners or buttons apart and move them away from each other. Also, unlike conventional fasteners such as button assemblies which have to be fastened and released sequentially, an array of magnetic buttons can be simultaneously fastened or released.

The above distinctive characteristics find magnetic fasteners particularly useful in circumstances in which the fasteners are required to be done and undone with a single hand and within a short time. For example, magnetic fasteners are useful in costumes for artists or performers who need to change frequently on stage. They are also useful for workers who wear work clothes and vests which may be caught by machinery or moving objects. Clothes or work vests with magnetic buttons provide easy escape to save the wearer from being caught and hurt when the clothes or vests are engaged accidentally.

As mentioned above, typical magnetic buttons include a pair of complementary parts which are releasably attachable to each other by magnetic attraction. Each of the detachable parts usually includes a magnetic member in slab or tablet form having a top and a bottom magnetic coupling surfaces with the opposite magnetic poles formed on them. The magnetic coupling surfaces are usually interconnected by a continuous peripheral edge which is usually quite thin for aesthetic and styling consideration. The magnetic slabs or tablets are usually cylindrical in shape with substantially identical top and bottom surfaces.

The magnetic slabs or tablets are generally enclosed in a magnetic permeable housing which are made, for example, of rubber, Nylon, fabrics, plastics (such as ABS or PVC) or synthetic resin. The housing makes decoration to the magnetic fasteners possible by providing a cover of aesthetic design to the magnetic member which usually has a monotonous and dull metallic appearance as well as providing weathering shield to the magnetic material to slow down or retard undesirable rusting. In this regard, the enclosure is preferably water- or air-tight so that even if the magnet member is oxidized, the enclosure still provides a cosmetic cover to hide the rusted surfaces from the outside, thereby making magnetic buttons suitable for applications in which product presentation and appearance are important.

To further enhance the convenience and usefulness of magnetic fasteners, magnetic fasteners are always made with complementary magnetic members having identical shapes and dimensions. As a result of the substantially identical dimensions of the complementary magnetic coupling surfaces on the detachable parts, the parts will come into substantially automatic alignment once they come into contact and no external help is therefore required in general for the initial contact and the subsequent engagement.

In view of the many advantages offered by magnetic buckles, it will be expected that magnetic belt or strap fasteners or buckles should be much more widely used, for example and especially, in applications where the buckles are hard to reach or locate or in applications where the buckles are normally concealed underneath other surfaces during use. One example of such applications is in lingeries or brassieres where the buckles are usually located at the back or at locations which are not conveniently accessible. Another example is for braces in which some of the fasteners are to be fastened to the back of trousers. In these applications, the appearance of the fasteners is usually important as their selection is sometimes considered to be representative or reflective of the taste of the user. Hitherto, magnetic buckles are not as widely used as expected in such applications. One main reason for this is probably because conventional magnetic fasteners buckles are very complex, of a bulky build and are expensive, heavy and unsightly and sometimes difficult to use. Another reason is the fear of accidental disengagement. More importantly, since magnetic buttons are characterised by engagement by mutual magnetic attraction of the coupling surfaces having opposite or complementary magnetic polarities and since magnetic coupling forces are usually strongest in the direction which is substantially normal or perpendicular to the coupling surfaces, the mutual lateral attraction is relatively weak and lateral dislocation of the buttons may occur relatively easily by lateral pulling of the buttons which may cause inadvertent or accidental disengagement of the fasteners when a lateral tension is applied. While it may be possible to retard undesirable lateral movement by providing matted or frictional coupling surfaces, this would usually decrease the ease of self alignment between the coupling surfaces and are therefore is not an attractive option.

For example, European Patent Application No. EP923887 discloses a magnetic closure with mutual interlock for bags, knapsacks and items of clothing. This device combines a magnetic closure with a snap-acting closure that contains a pair of male and female parts. In the preferred embodiment, the male element forms a projection that contains a catch for insertion into a slot of the female element for interlocking purposes to prevent natural slippage. Pressing action of the male element allows a user to unlock and separate the two parts. Such a design would effectively require two actions for unlocking of the closure: the pulling apart of the magnet, and the opening of the male and female elements.

Hence, it will be desirable if magnetic buckles having at least some of the afore-mentioned shortcomings overcome or alleviated can be provided so that light, reliable and simple strap fasteners can be provided. Preferably such strap fasteners should have a low-profile structure which allows decoration to be conveniently and easily added to the buckles to make them more aesthetically pleasing—an important aspect if magnetic buckles are to be widely used in lingerie, fashions or apparel. In addition, a low-profile structure usually alleviates the risks of damages to the covering or adjacent soft materials. Naturally, it is highly desirable if such fasteners can be snap-fitted and easily disengageable as and when desired by the user.

Throughout this specification, the terms fasteners, buckles and buttons are used interchangeably for brevity and succinctness to the extent that is appropriate for the context.

OBJECT OF THE INVENTION

It is therefore an object of the present invention to provide a magnetic strap fastener or buckle which is light, of a simple structure and inexpensive. In addition, the strap fastener or buckle should have a low-profile build so that it can be easily and conveniently concealed under clothes or other surfaces for aesthetic consideration so that such fasteners can be generally used in the manufacture of underclothings such as brassieres and lingeries. Preferably, in addition to the afore-mentioned requirements, the buckles should be reasonably reliable so that the risks of accidental disengagement of the buckles or strap fasteners are minimal. As a minimum, it is the object of the present invention to provide the public with a choice of a new form of magnetic fasteners as described herein.

SUMMARY OF THE INVENTION

According to one aspect of the present invention, there is provided a magnetic buckle or strap fastener including a housing and a pair of magnetic member, said magnetic member includes a first surface of a first magnetic polarity and an opposing second surface of a second and opposite magnetic polarity defining a magnetic axis therebetween, the housing includes a receptacle for receiving said magnetic member so that at least a portion of said magnetic member will be substantially exposed; and a strap receiving means extending away from said peripheral wall in a direction preferably substantially perpendicular to the magnetic axis.

According to a further aspect, the present invention provides a fastener including a housing and a magnetic member. The magnetic member includes a first surface and an opposing second surface corresponding to a first magnetic pole and a second magnetic pole respectively, with the first and second magnetic poles defining a magnetic axis therebetween. The housing contains a receptacle for receiving the magnetic member, a strap receiving means extending from the receptacle, and a stopping mechanism for preventing lateral slippage when the fastener is functionally engaged with another matching fastener. The stopping mechanism is preferably provided in the housing and adapted to engage the matching fastener containing a matching housing and a matching magnetic member. The stopping mechanism is designed in the housing such that it is capable of being disengaged in a single action to pull the fastener and matching fastener apart along a direction substantially parallel to the magnetic axis.

Preferably, the strap receiving means is substantially equi-distant from both polar surfaces of said magnetic member.

Preferably, the holder includes a base portion and a wall extending upwardly from the perimeter of said base portion, said base portion is adjacent one surface of said magnetic member and said wall is adapted to surround the peripheral wall of said magnetic member.

Preferably the wall discontinues at about the junction between said strap receiving means and said base portion.

Preferably, the holder includes a wall surrounding the peripheral wall of said magnetic member, said wall includes an elevated portion protruding beyond the exposed magnetic surface.

Preferably, the elevated portion is adapted so that when said strap fastener is magnetically coupled with a counterpart strap fastener of the same design, said elevated portion will not push against the strap receiving means of the counter-part fastener while forming a barrier member to stop relative lateral movement along the directions of the strap receiving means.

According to another aspect of the present invention, there is provided a strap fastener or a buckle including a housing and a magnetic member, said magnetic member includes a first and a second magnetic polar surfaces respectively of a first and a second magnetic polarities which together define a magnetic axis, said housing includes a receptacle for receiving said magnetic member and a strap receiving means, said strap receiving means is formed on said receptacle and is transverse to said magnetic axis.

Preferably, the strap fastener further including a projection which is disposed on the edge of said receptacle at a position which is substantially opposite to said strap receiving means and which extends beyond the magnetic polar surface which is adapted for coupling with a counterpart magnetic coupling surface.

According to yet another aspect of the present invention, there is provided a buckle or strap fastener comprising a pair of engageable magnetic fasteners of opposite polarity to each other engageable or a common axis and a strap engagement portion connected to each magnetic fastener and extending transverse to said common axis of engagement of said magnetic fasteners. Preferably, said fastener includes at least one protrusion to reside against a perimeter of an opposed magnetic fastener to resist lateral movement of one magnetic fastener with respect to the other and transverse to said common axis on which they engage.

BRIEF DESCRIPTION OF THE DRAWINGS

Preferred embodiments of the present invention will now be explained by way of examples and with reference to the accompanying drawings in which:

FIG. 7A is an exploded cross sectional side view of a magnet set according to a further embodiment of the present invention.

FIG. 7B is the cross sectional side view of the same magnet set as in FIG. 7A.

FIG. 7C is the top view of the same magnet set as shown in FIG. 7A.

DETAILED DESCRIPTION OF THE PREFERRED EMBODIMENTS

Figure 1:
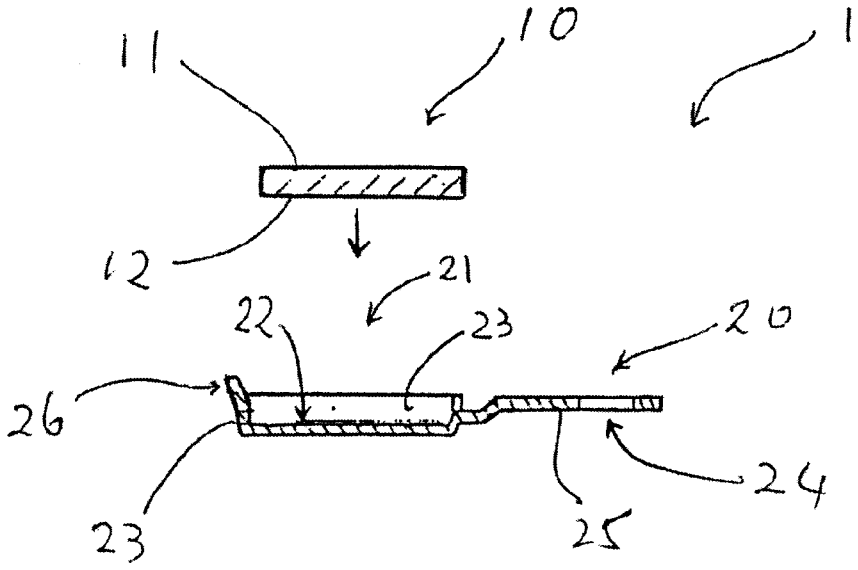
FIG. 1 illustrates the cross-sectional of a magnetic member and a housing to be described in the first embodiment of the present invention
Figure 2:
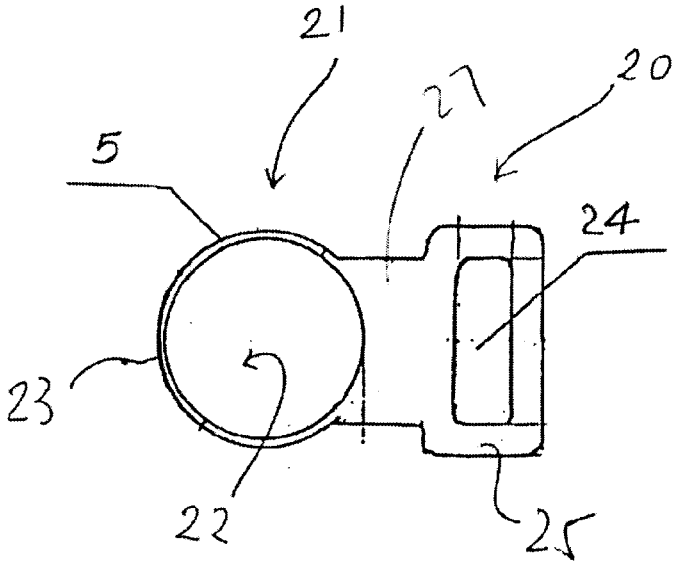
FIG. 2 shows the top plan view of the housing of FIG. 1.
Figure 3:
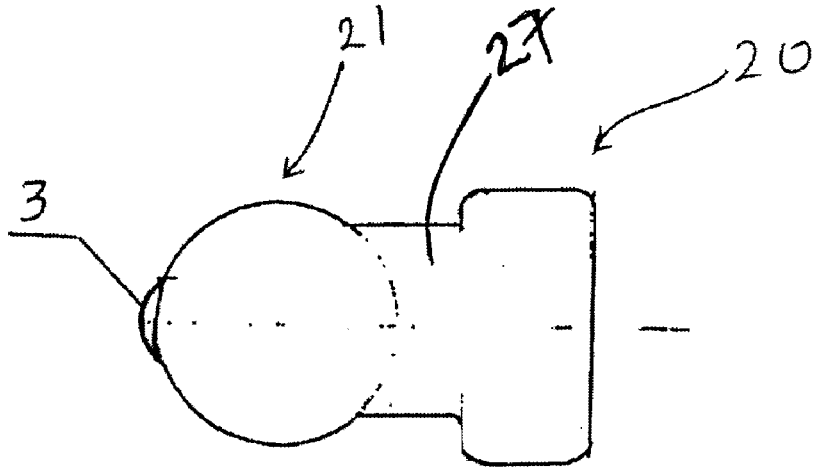
FIG. 3 is a diagram showing generally the housing and indicating a protruding portion extending from the peripheral wall of the holder to alleviate undesirable relative lateral slippage of a buckle pair.

Referring firstly to FIGS. 1 to 3, there are shown a magnetic member (10) and a housing (20) which, when assembled together, form a first preferred embodiment of the present invention of a magnetic buckle. The magnetic member (10) is the source of the magnetic coupling force for engaging with a counterpart magnetic buckle. Preferably, this magnetic member includes a permanent magnet in the form of a magnetic slab made of a strong magnetic substance or alloy in order to provide a large magnetic force-to-volume ratio essential for a compact buckle design. With the current magnetic technology, a pair of complementary magnetic slabs having a diameter of 1 cm and a thickness of about 1 mm and with an appropriate design as mentioned herein can produce a magnetic coupling force of up to 20–30 N.

In the present preferred example, the magnetic slab is substantially circular or cylindrical with a diameter of about 12 mm and a thickness of less than 1 mm. To provide a maximum magnetic coupling area, the two opposite magnetic poles are preferably disposed on the two opposing planes (11, 12) of the magnetic slab so that the North pole is on one of the planar surfaces while the South pole is on the other with a perimeter wall (12A) therebetween. To increase the magnetic flux intensity on the coupling surface, the magnet member is preferable embedded within a casing made of a magnetic material, such as an iron, steel or other ferromagnetic casing, with one of the magnetic coupling surface exposed. With such an embedment of a strong magnet on a ferro-magnetic casing, the magnetic strength of the exposed coupling surface is considerably strengthened by concentration. Of course, magnetic members of other shapes and thickness can equally be used without loss of generality. For example, the magnetic member can be made into a rectangular, polygonal, trapezoidal or even irregular or non-geometric cross-section. In addition, a ring- or toroidal shaped magnetic member can also be utilized.

The housing includes a holder portion (21) or receptacle for receiving the magnetic member and a strap receiving portion (25) for anchoring a flexible end of a strap for releasable engagement with a counter-part magnetic buckle. The magnetic member holder portion includes a base portion (22) which preferably conforms closely to the base dimensions of the magnetic member and an upstanding fencing wall (23) which extends upwardly along the perimeter of the base portion. The combined structure of the base portion together and the peripheral fencing wall provides a cavity casing within which the magnetic member is received with the magnetic coupling surface (11) exposed and unobstructed. The cavity casing, which includes the base portion (22) and the upwardly extending parametric peripheral wall (23), is preferably made of a magnetic material, for example, a ferro-magnetic substance such as chromium or Nickel plated steel. The magnetic member can be glued to the cavity housing or retained by other means, including mechanical retention or embedment. When the magnetic member is enclosed by a magnetic material and with an exposed surface, the magnetic strength of the exposed magnetic surface will be reinforced and maximized, and the magnetic coupling forces, when coupled with the opposite magnetic surface (10) of a similarly designed counterpart magnetic buckle, will be greatly enhanced when compared to magnetic members not so encased. With such a design, a more compact buckle with a strong magnetic strength can be provided.

The strap receiving portion (25) includes a means (24) for receiving or otherwise connecting to the flexible end of a flexible strap. To enhance secured retention of the strap, the receiving portion may include a serrated slot or notch.

The strap receiving portion (25) includes a means (24) for receiving the flexible end of a flexible strap in order to form a strap with a buckled end. To improve better retention of the strap end, the receiving portion may include a serrated slot or notch. In order to provide a low-profile buckle design, the strap receiving portion is relatively thin with a thickness which is preferably equal to or less than that of the peripheral wall of magnetic member. In addition, the strap receiving portion is preferably formed by placing it adjacent to the peripheral edge joining the magnetic polar surfaces rather than extending from either polar surfaces so that an over-all low-profile structure can be obtained.

In the present embodiment, the strap receiving portion contains a rigid bridging portion which extends away from the cavity casing in a lateral or radial manner. In this arrangement, the strap receiving portion is substantially equi-distant from both polar surfaces and is joined to the cavity casing by the rigid bridging portion (27). The bridging portion (27) preferably includes a ribbon-shaped plate member with its wide surfaces substantially parallel to the magnetic coupling surfaces (11, 12). Of course, instead of ribbon shaped member, a thin shaft member may be used to join the strap receiving portion and the cavity casing. In any event, the portion of the housing which extends away from the cavity casing should be of a slim design so that an overall low-profile design can be achieved. For example and as shown in the Figures, a substantial portion of that extension is preferably flat and the whole portion should be kept within the height of the peripheral wall of the magnetic member (10). Alternatively, the strap-receiving means may be formed proximate and adjacent to the peripheral wall joining the polar surfaces (11, 12) so that it is substantially equidistant from both polar surfaces (11, 12). Forming the strap-receiving means sidewise of the polar surfaces will always provide a desirable low-profile structure.

Figure 4:
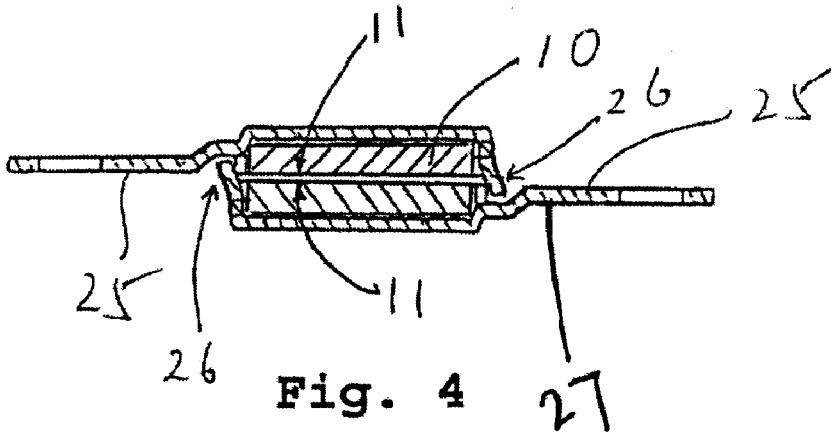
FIG. 4 is a cross sectional view illustrating a pair of the buckles engaged together.

Referring now to FIG. 4 in which there are shown a pair of complementary counterpart magnetic buckles in magnetic engagement, it can be seen that the magnetic coupling surfaces of the counterpart buckles A and B with magnetic coupling surfaces (11) of the opposite magnetic polarities are in physical contact. It should be noted that while it is preferable that both of the complementary buckles are of the same structural design as mentioned herein, a buckle of a different design but of a complementary nature can be used as a counterpart buckle or fastener.

As can be seen from this Figure, the laterally or radially extending strap receiving portions help to reduce the overall thickness of the engaged buckle pair, making the assembly particularly suitable for use in circumstances, for example in lingerie and brassiere applications, where a thin assembly is desirable.

Furthermore, in order to alleviate the risks of undesirable or accidental disengagement of the magnetically coupled buckle pairs, the portion of the peripheral wall at the end of the cavity casing directly opposing the strap receiving portion is made with a small projection or with an elevated teeth (26) resembling portion. The protruding portion (26) of the buckle is formed on the cavity wall (23) and extends beyond the surface of its magnetic coupling surface (11). This projection (26) will become a barrier member to the magnetic member (10) of the counterpart buckle by extending also beyond the magnetic coupling surface (11) of the counterpart buckle. With the elevated portion engaging with the edge of the magnetic member of the corresponding counterpart buckle, undesirable lateral slippage in both the left and right directions, i.e., directions along both strap receiving portions can be greatly alleviated. When the buckles are to be uncoupled, a user only needs to slightly lift one of the buckles, for example, by pivoting against the counterpart buckle and then separating the buckles. To ensure sufficient space for accommodating the protruding member (26) without having to press against the bridging portion, a slight indentation corresponding to the location of the protruding portion is preferably provided so that the teeth (26) can rest above and away from the bridging portion. This slight indentation may also be accompanied by a discontinuation of the perimetric wall at the corresponding position to allow engagement of the teeth member. As shown in the Figures, the indentation is formed at the intersection or junction between the bridging portion and the cavity housing.

In the present specific example, the housing is integrally formed of a magnetic material so that one of the magnetic surfaces is in contact with the base portion while the peripheral wall of the magnetic member is enclosed within the cavity housing, leaving the magnetic coupling surface exposed. Where a ring- or toroidal-shaped magnet member is used, the cavity housing may have a hollow base portion. To provide a decoration or an aesthetic design, the buckle may be enclosed within a thin magnetic permeable enclosure made, for example of, PVC, synthetic resins, rubber, Nylon or the like material. Furthermore, while the permanent magnet (10) is held by a holder portion which is made preferably of a magnetic material in order to strengthen and concentrate the magnetic force on the exposed polar surface of the permanent magnet, it should be appreciated that the present invention can be made by having a magnetic enclosed within a housing which does not have the effect of concentrating the magnetic strength on a particular polar surface as long as there is provided a strap receiving means transverse or side-wise to the magnetic axis of the permanent magnet.

Figure 5A:
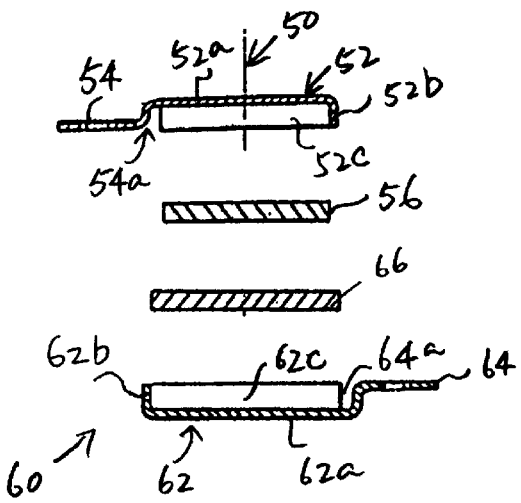
FIG. 5A is an exploded cross sectional view of a pair of fasteners according to another embodiment of the present invention.
Figure 5B:
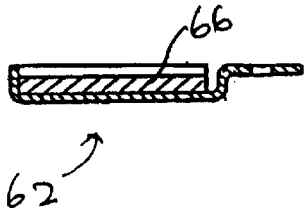
FIG. 5B is a cross sectional view of a fastener according to the present invention.
Figure 5C:
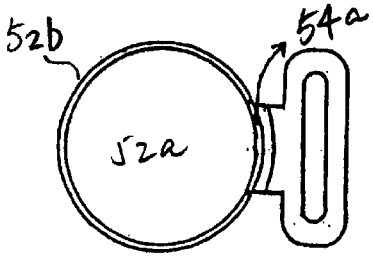
FIG. 5C is a top plan view of the same fastener as in FIG. 5B.

In another embodiment of the present invention as shown in FIGS. 5A to 5B, a strap fastener (50) contains a housing (52) and a magnetic member (56) similar to the one described in the previous embodiment including strap receiving portion (54) and receptacle (52*c*). Receptacle (52*c*) contains a base portion (52*a*) and side wall (52*b*). In this embodiment, the base portion (52*a*) is circular in shape with one side (54*a*) extending outwards to connect with the strap receiving portion (54). A magnet (56) of the same dimension as the base portion (52*a*) is provided for attachment into the receptacle (52*c*). In this embodiment, another strap fastener (60) having a housing portion (62) with a strap receiving portion (64) is provided to engage the first fastener (50) for proper functioning of this pair of fasteners. The base portion (62*a*) of the second fastener (60) is larger in diameter compared to the base portion (52*a*) of the first fastener (50). Another magnet (66) larger in diameter than the first magnet (56) is provided for attachment into the receptacle area (62*c*) of the larger fastener (60). The perimeter wall (62*b*) of the larger fastener (60) is higher than the height of the attached magnet (66) as shown in FIG. 5B. As in the smaller fastener, the base portion (62*a*) of the larger fastener (60) is connected to the strap receiving portion (64) via an extended side (64*a*).

Figure 5D:
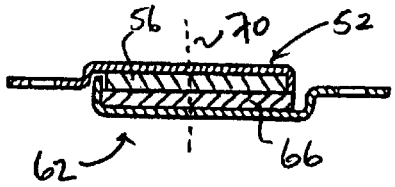
FIG. 5D is a cross sectional side view of a pair of fasteners functionally engaged according to the same embodiment of the present invention.
Figure 5E:
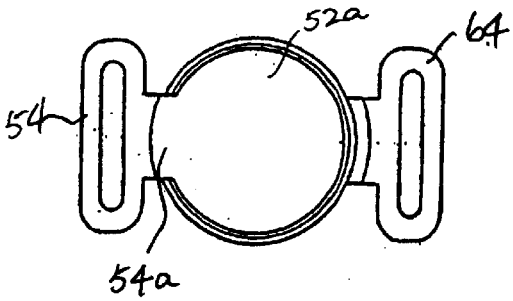
FIG. 5E is a top plan view of the same pair of fasteners according to FIG. 5D.

During operation, the smaller fastener (50) is attached to the larger fastener (60) as shown in FIG. 5D. As the side wall (62*b*) of larger fastener (60) is higher than the magnet (66) attached, the smaller strap fastener (50) will engage larger fastener (60) in a manner such that the extended portion of the side wall (62*b*) will act as a stopping mechanism to prevent lateral movement between smaller fastener (50) and larger fastener (60). To disengage the two fasteners, a twisting force or pulling force in a direction substantially parallel to the magnetic axis (70) may be used in a single action. No further action is required to disengage the stopping mechanism.

As can be seen by the previous discussion, the phrase "substantially parallel to the magnetic axis" is meant for ease of understanding and includes a twisting action to pull a pair of magnetic fasteners apart.

Figure 6A:
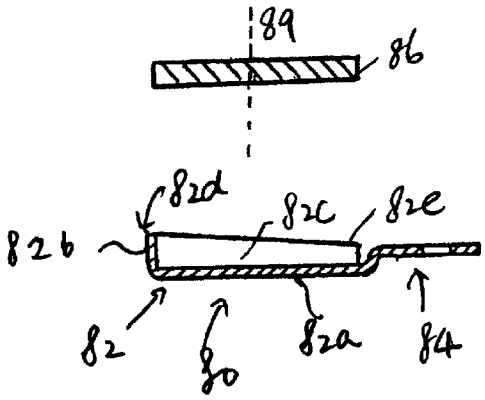
FIG. 6A is an exploded cross sectional side view of a fastener according to yet another embodiment of the present invention.
Figure 6B:
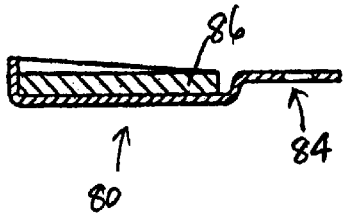
FIG. 6B is the cross sectional side view of the same fastener as in FIG. 6A.
Figure 6C:
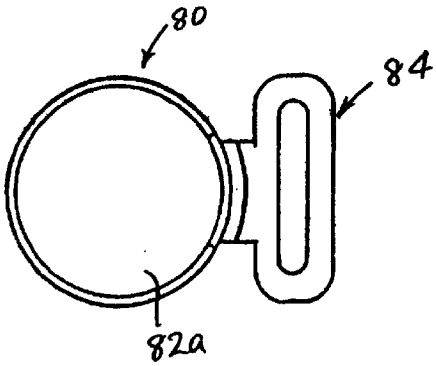
FIG. 6C is the top plan view of the same fastener as FIG. 6A.

In another embodiment shown in FIGS. 6A to 6E, the strap fastener (82) according to another embodiment of the present invention has a housing containing a receptacle (80) and a strap fastening portion (84) similar to the previous embodiments. The main difference in this embodiment is that the peripheral wall (82*b*) that is attached to the circular base portion (82*a*) of the receptacle (80) of the strap fastener (82) is bevelled with a tall end (82*d*) and a short end (82*e*). The tall and short ends are preferably on opposite sides of the circularly shaped base portion (82*a*) with the short side (82*e*) adjacent the strap fastening portion (84). The magnet (86) has a thickness that is shorter than the tall end (82*d*) of the peripheral wall, but approximately the same height as the short end (82*e*) as shown in FIG. 6B. As in the other embodiments, a connecting area (84*a*) connects the strap fastening portion (84) to the receptacle (82). The connecting portion (84*a*) is extending outwards from the base portion as shown in FIG. 6B and FIG. 6C.

Figure 6D:
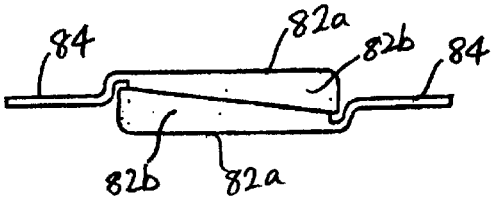
FIG. 6D is the cross sectional side view of a pair of fasteners functionally engaged according to the same embodiment as in FIG. 6A.
Figure 6E:
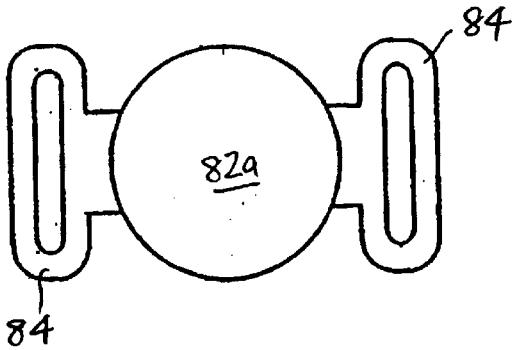
FIG. 6E is a top plan view of the same pair of fasteners as in FIG. 6D.

During fastening engagement, as shown in FIG. 6D, two bevelled fasteners with facing magnetic poles attracting each other according to the present embodiment may be engaged in facing directions with the tall end of the wall (82*d*) coupled to the short end (82*e*) of the wall. In the preferred embodiment, the tall end (82*d*) is tall enough to extend within the extended portion (84*a*). It is clear from the description above that lateral movements parallel to the strap fastener portion and perpendicular to the magnetic axis (89) is restricted as the engagement of the tall end with the short end together with the bracing action of the strap fastening portion acts as the stopping mechanism in the present embodiment. The advantage of this embodiment is that lateral rotational movement between the two engaged fasteners is minimized due to the restrictions engaged by the two bevelled walls when they are functionally engaged.

While the magnet in the above description is described as being disc-shaped, it is clear that any magnetic element that can function within the receptacle and would fall within the scope of the present invention. As shown in FIGS. 7A to 7C, the magnet according to the present invention may also be of a ring shape as shown by reference numeral 80 of FIG. 7C. A base plate (82), preferably with a raised internal circular portion (82*b*), is preferably provided for attachment onto the magnetic ring (80). The entire magnetic element (including plate (82) and ring (80)) can then be used like a magnet for attachment to the receptacle in the fastening. For example, the magnet shown in reference numerals 86, 56 and 66 may actually consist of a magnetic ring and a metallic disk as shown in FIG. 7B. The advantage of such a magnetic set is that expensive magnetic material may be reduced due to the hole in the center of the ring. This, however, does not substantially reduce the magnetism of the magnet set because the base plate may be made of substance such as chromium or of nickel-plated steel that can concentrate a ferro-magnetic substance such as chromium or nickel-plated steel that can concentrate the magnet along magnetic axis (88) and in the direction unshielded by the base plate. The base plate is the side of the magnetic set that is attached to and adjacent the base portion of the previously-described fasteners while the magnetic ring is exposed for interaction with another magnet attached to a matching fastener.

While the present invention has been explained by reference to the preferred embodiments above, it should be appreciated that the embodiments are provided for illustration and assisting understanding only and do not intend to limit or restrict the scope of the present invention. For ease of description, the polarity of the magnetic members of each of the fasteners have not been specifically stated. It is however clear for one of ordinary skilled in the art that for a pair of fasteners to work according to the present invention, each pair of functionally engaged fasteners would have magnetic members of opposite polarity facing each other in the two matching fasteners.

What is claimed is:

1. A fastener including a housing and a magnetic member, said magnetic member including a first magnetic surface and an opposing second magnetic surface corresponding to a first magnetic pole and a second magnetic pole respectively, said first and second magnetic poles defining a magnetic axis therebetween, said housing including:

a receptacle for receiving said magnetic member;

a strap receiving means extending from said receptacle; and a stopping mechanism provided in said housing adapted to engage a matching fastener containing a matching housing, said stopping mechanism preventing lateral slippage between said fastener and said matching fastener in a direction substantially perpendicular to said magnetic axis when said fastener and said matching fastener are being coupled, said stopping mechanism further facilitating disengagement of said fastener from said matching fastener by providing a pivotal support to said fastener so that the engaged first magnetic surface of said fastener can be pivotally moved away from said matching fastener unobstructed by the housing of said matching fastener by applying force on said strap receiving means about said pivotal support.

2. The strap fastener of claim 1, wherein said first magnetic surface and said second magnetic surface are interconnected by a peripheral wall, said first magnetic surface of said magnetic member being proximal and adjacent to the base portion of said receptacle and said second magnetic surface being distal from said base portion of said receptacle, and said stopping mechanism includes an elevated portion extending upwardly from the base portion of said receptacle and protruding beyond said second magnetic surface of said magnetic member, said elevated portion being generally opposite to said strap receiving means and said magnet member being intermediate of said elevated portion and said strap receiving means, said elevated portion being disposed so that when said fastener is engaged with said matching fastener, an upper end of said elevated portion approaches the housing of said matching fastener and prevents said fastener from moving along the direction of extension of said strap receiving means and, when said fastener is being disengaged from said matching fastener by lifting said strap receiving means about said pivotal support, said upper end of said elevated portion is pressed against said housing of said matching fastener and prevented from passing through said housing of said matching fastener.

3. The fastener of claim 2, wherein said fastener further includes an indented portion for receiving the elevated portion of the stopping mechanism of said matching fastener, said indented portion being generally complementary to said elevated portion and being disposed generally opposite to said elevated portion and intermediate said magnetic member and said strap receiving means.

4. The fastener of claim 2, wherein said elevated portion is adapted so that when said fastener is being magnetically coupled with said matching fastener, said elevated portion advances towards the housing of said matching fastener generally along said magnetic axis but does not push against magnetic force to lift said first magnetic surface of said fastener from said matching fastener.

5. The fastener according to claim 2, wherein an air gap is formed between said magnetic member and the portion of said housing interconnecting said receptacle and said strap receiving means, said air gap being adapted to receive the elevated portion of the stopping mechanism of said matching fastener.

6. The fastener of claim 2, wherein said receptacle includes a ferro-magnetic side wall extending upwardly from said base portion and surrounding a major portion of said peripheral wall of said magnetic member, and said elevated portion protrudes from said side wall and extends along a minor portion of said side wall.

7. The fastener according to claim 6, wherein said side wall is beveled with opposing tall and short sides, with said short side being proximate said strap receiving means and said tall side being distal therefrom.

8. The fastener of claim 6, wherein an upper side of said side wall is generally level with said second magnetic surface of said magnetic member, and said upwardly extending side wall discontinues at the junction between said strap receiving means and said magnetic member so that said magnetic member is communicable with said indented portion, said discontinuity also defining the limits of said indented portion along said magnetic member for receiving the elevated portion of a counterpart fastener.

9. The fastener of claim 6, wherein the protrusion of said elevated portion of said receptacle above said second magnetic surface and the depth of said indented portion are such that when said strap fastener is complementarily coupled with said matching fastener, said second magnetic surface and the corresponding second magnetic surface of the counterpart fastener are substantially parallel.

10. The fastener of claim 6, wherein an upper side of said side wall is substantially level with said second magnetic surface of said magnetic member, and when said fastener is coupled with said matching fastener, the corresponding magnetic surfaces and the side walls of the counterpart strap fasteners are in substantial contact.

11. The fastener of claim 6, wherein said peripheral wall of said magnetic member is substantially circular and said elevated portion is located substantially diametrically opposite said indented portion.

12. The fastener of claim 11, wherein said indented portion generally extends along the peripheral wall of said magnetic member at about the junction of said magnetic member and said strap receiving means, and said indented portion generally follows the curvature of said peripheral wall and is long enough to allow translation of the elevated portion of a counterpart fastener of matching design along said indented portion when said fastener is coupled with a counterpart fastener.

13. The fastener of claim 11, wherein said side wall is generally circular and substantially follows the curvature of said peripheral wall of said magnetic member, and said elevated portion also substantially follows the curvature of said side wall.

14. The fastener of claim 11, wherein said second magnetic surface of said magnetic member is substantially exposed, and said side wall of said receptacle is made of a ferro-magnetic material.

15. The fastener of claim 14, wherein said indented portion for complementarily receiving the elevated portion of said matching fastener is intermediate said peripheral wall of said magnetic member and said strap receiving means, and said elevated portion, said indented portion and said strap receiving means are generally disposed along a straight line.

16. The fastener of claim 15, wherein said peripheral wall of said magnetic member is communicable with said indented portion and the protrusion of said elevated portion above said second magnetic surface of said magnetic member does not exceed the depression of said indented portion below said second magnetic surface of said magnetic member.

17. The fastener of claim 15, wherein said housing is integrally formed from a ferro-magnetic sheet.

18. A pair of fasteners including a fastener according to claim 2 and a matching fastener wherein:

a magnetic member of said matching fastener includes a matching first magnetic surface and a matching second magnetic surface interconnected by a matching peripheral wall and defining a second magnetic axis therebetween;

a housing of said matching fastener includes a matching receptacle with a matching base portion and a matching side wall having a first end attached to said base portion and a free end extending upward from the perimeter of said matching base portion, and said matching magnetic member is attached to said receptacle with said matching first magnetic surface of said matching magnetic member adjacent to said matching base portion and the free end of said matching wall extending beyond said matching second surface, said matching wall further having a perimeter larger than the perimeter of said wall and said base portion such that said free end of said matching receptacle surrounds said receptacle when said fastener and said matching fastener are functionally engaged.

19. The pair of fasteners of claim 18, wherein said peripheral wall of said magnetic member and said matching peripheral wall of said matching magnetic member are substantially circular and of unequal perimeter.

20. The fasteners of claim 18, wherein said matching base portion of said matching fastener and said base portion of said fastener are substantially circular and the diameter of said matching base portion is larger than that of said base portion of said fastener.

21. The fasteners of claim 28, wherein said matching side wall of said matching fastener protrudes above said matching second magnetic surface of said matching magnetic member.

22. The fasteners of claim 20, wherein said housing of said fastener and said matching housing of said matching fastener do not respectively obstruct the pivotal movement of said matching housing and said housing about their respective elevated portions.

23. The fasteners of claim 18, wherein said housing and said matching housing are made of a ferro-magnetic material.

24. A fastener comprising a pair of engageable magnetic fasteners of opposite polarity to each other engageable on a common axis and a strap engagement portion connected to each magnetic fastener and extending transverse to said common axis of engagement of said magnetic fasteners, said fastener including at least one protrusion to reside against a perimeter of an opposed magnetic fastener to resist movement of one magnetic fastener with respect to the other transverse to said common axis on which they engage, wherein said protrusion facilitates disengagement of said magnetic fasteners by providing a pivotal support for the separation of said magnetic fasteners of opposite polarity.

* * * * *